US007246444B2

(12) United States Patent
Nashimoto et al.

(10) Patent No.: US 7,246,444 B2
(45) Date of Patent: Jul. 24, 2007

(54) CUTTING TOOL WITH GUIDE MEMBER CLAMPING MEANS

(75) Inventors: Tomonobu Nashimoto, Anjo (JP); Yukiyasu Okouchi, Anjo (JP); Takahiro Kamiya, Anjo (JP)

(73) Assignee: Makita Corporation, Anjo (JP)

( * ) Notice: Subject to any disclaimer, the term of this patent is extended or adjusted under 35 U.S.C. 154(b) by 15 days.

(21) Appl. No.: 11/272,697

(22) Filed: Nov. 15, 2005

(65) Prior Publication Data

US 2006/0117578 A1 Jun. 8, 2006

(30) Foreign Application Priority Data

Dec. 8, 2004 (JP) ..... 2004-355811

(51) Int. Cl.
*B27B 9/02* (2006.01)

(52) U.S. Cl. ..... 30/377; 30/375; 30/390; 403/321; 403/DIG. 4

(58) Field of Classification Search ..... 30/375–377, 30/391; 403/109.5, 184, 87, 257, 322.4, 403/321, 330, DIG. 4, 375, 320; 292/34, 292/65, 159, 247, 257, 256.75; 411/272–273; 16/53, 296; 24/170, 635, 328, 330
See application file for complete search history.

(56) References Cited

U.S. PATENT DOCUMENTS 4,672,746 A * 6/1987 Zeilenga ..... 30/391
5,481,806 A * 1/1996 Pratt ..... 30/391
5,570,511 A * 11/1996 Reich et al. ..... 30/376
5,931,516 A * 8/1999 Holtman et al. ..... 292/257
6,301,789 B1 * 10/2001 Zeiler et al. ..... 30/388
6,523,910 B1 * 2/2003 Lin ..... 301/111.06
6,588,112 B2 * 7/2003 Zeiler et al. ..... 30/391
6,925,720 B2 * 8/2005 Ranieri ..... 30/513
7,128,495 B1 * 10/2006 Lill et al. ..... 404/4
2001/0029819 A1 * 10/2001 Okouchi ..... 83/13
2003/0024128 A1 * 2/2003 Kani ..... 30/376
2004/0103544 A1 * 6/2004 Hartmann ..... 30/388
2005/0217124 A1 * 10/2005 Fuchs et al. ..... 30/377

FOREIGN PATENT DOCUMENTS

JP B2 2829714 9/1998
JP B2 3427431 5/2003
WO WO 2004/060621 * 7/2004

* cited by examiner

*Primary Examiner*—Boyer D. Ashley
*Assistant Examiner*—Laura M. Lee
(74) *Attorney, Agent, or Firm*—Oliff & Berridge PLC

(57) ABSTRACT

A cutting tool that improves operability by facilitating operation of a lever for operating a clamp mechanism of a guide member is provided. A clamp mechanism is constituted by a clamp pin that protrudes its distal end to the outside of the blade case while penetrating a depth guide and the blade case, a first lever that is connected to the distal end of the clamp pin and directly moves the clamp pin in the axial direction, and a second lever that is connected to the upper portion of the first lever through a connecting pin and has a cam lever. When the second lever is rotated toward the blade case, the cam lever presses the connecting pin to tilt the first lever, whereby the clamp pin is pulled outward. As a result, the depth guide is pressed to the inner surface of the blade case and clamped.

15 Claims, 4 Drawing Sheets

CUTTING TOOL WITH GUIDE MEMBER CLAMPING MEANS

BACKGROUND OF THE INVENTION

This application claims the benefit of Japanese Patent Application Number 2004-355811 filed on Dec. 8, 2004, the entirety of which is incorporated by reference.

1. Field of the Invention

The present invention relates to a cutting tool, such as a circular saw or a cutter, in which a main body having a cutting blade that rotates driven by a motor is provided on a base, and the cutting blade protrudes below the base so as to cut a workpiece.

2. Description of the Related Art

A conventional circular saw has a base which is rectangular in a plain view and a main body provided on the base and having a circular saw blade (cutting blade) driven to rotate by a motor. When the saw blade protrudes below the base, and the base is slid on the workpiece, the workpiece is cut by the saw blade. In this circular saw the front end of a blade case covering the upper part of the saw blade is mounted on the base rotatably in the upper and lower directions. On the other hand, the rear end of the blade case can be slid along an arcuate guide member standing on the base, and can be fixed at an arbitrary position along the guide member by a clamp mechanism provided on the blade case. As a result, an amount of protrusion of the saw blade (cutting depth) from the base can be adjusted.

As a well-known clamp mechanism, the Japanese Patent No. 2829714 discloses a structure including a blade case and a bolt threadedly mounted thereto for penetrating a guide member. Then a thumb nut is screwed to the bolt, so that the guide member is pressed and fixed to the inner surface of the blade case. On the other hand, the Japanese Patent No. 3427431 discloses a structure including a blade case and a cam lever for pressing a guide member provided along the outer circumference of the blade case. With this cam lever, the guide member is pressed and fixed to the outer surface of the blade case.

However, in a structure with a thumb nut screwing as disclosed in the Japanese Patent No. 2829714, rotative operation of the thumb nut in accordance with cutting depth adjustment is troublesome, which deteriorates operability. On the other hand, a cam lever disclosed in the Japanese Patent No. 3427431 improves operability compared with the above structure, because a guide member can be clamped or unclamped by rotative operation of the cam lever. Nevertheless, since powerful force is required to press and fix the guide member, a load on the cam lever in accordance with rotative operation increases, so that improvement of operability is insufficient.

In order to solve the above problem, an object of the present invention is to provide a cutting tool with excellent operability, adopting a lever structure to a clamp mechanism for lightly clamping and unclamping a guide member.

SUMMARY OF THE INVENTION

In order to achieve the above object, according to a first aspect of the present invention a lever that directly operates a clamp mechanism is connected to a second lever that rotates to be interlocked with the lever. With the rotative operation of the second lever, the clamp mechanism can be switched between a clamped condition and an unclamped condition through the lever.

According to a second aspect of the present invention based on the first aspect, in order to maintain an excellent operability without difficulty even when two levers are provided, the clamp mechanism has a clamp pin that protrudes to the outside of a blade case while penetrating through a guide member disposed at the inner side of the blade case, and the lever connected with the clamp pin. The lever is rotated around a portion where the lever abuts to the outer surface of the blade case as a fulcrum for pulling and urging the clamp pin in the protruding direction, thereby pressing the guide member to the inner circumference of the blade case. Moreover, there is provided a second lever which is a cam lever connected to the side of the force-applying point of the lever. The second lever slides on the outer surface of the blade case when the second lever is rotated to the side of the blade case so as to press the side of the force-applying point of the lever toward the direction that is remote from the outer surface of the blade case.

A third aspect of the present invention is based on the second aspect. According to the third aspect, in order to improve operability of the cam lever, a roller is provided at a sliding portion of the cam lever with respect to the outer surface of the blade case.

According to the first aspect, such a structure is adopted that the lever that directly operates the clamp mechanism is connected to the second lever that rotates to be interlocked with the lever, so that the lever can be easily operated by utilizing the second lever though the lever requires a heavy workload when it is operated directly. Consequently, a required workload is greatly reduced for the same clamping or unclamping effect compared with a single lever structure, which provides an excellent operability.

According to the second aspect, in addition to the effect of the first aspect, since the second lever is a cam lever, the cam lever is turned to the side of the blade case in a clamped condition, which provides no protrusion from the blade case even when two levers are provided. This structure prevents the cam lever from being an obstruct during operation and also prevents an accidental unclamping when the cam lever is knocked by a user's hand or an object. Therefore, an excellent operability can be maintained.

According to the third aspect, in addition to the effect of the second aspect, the workload for operating the cam lever is further reduced, which further improves operability.

BRIEF DESCRIPTION OF THE DRAWINGS

FIGS. 3A and 3B are explanation views of the clamp mechanism shown in section, in which FIG. 3A shows an unclamped condition and FIG. 3B shows a clamped condition.

DETAILED DESCRIPTION OF THE PREFERRED EMBODIMENT

Hereinafter, an embodiment according to the present invention is described based on the drawings.

Figure 1:
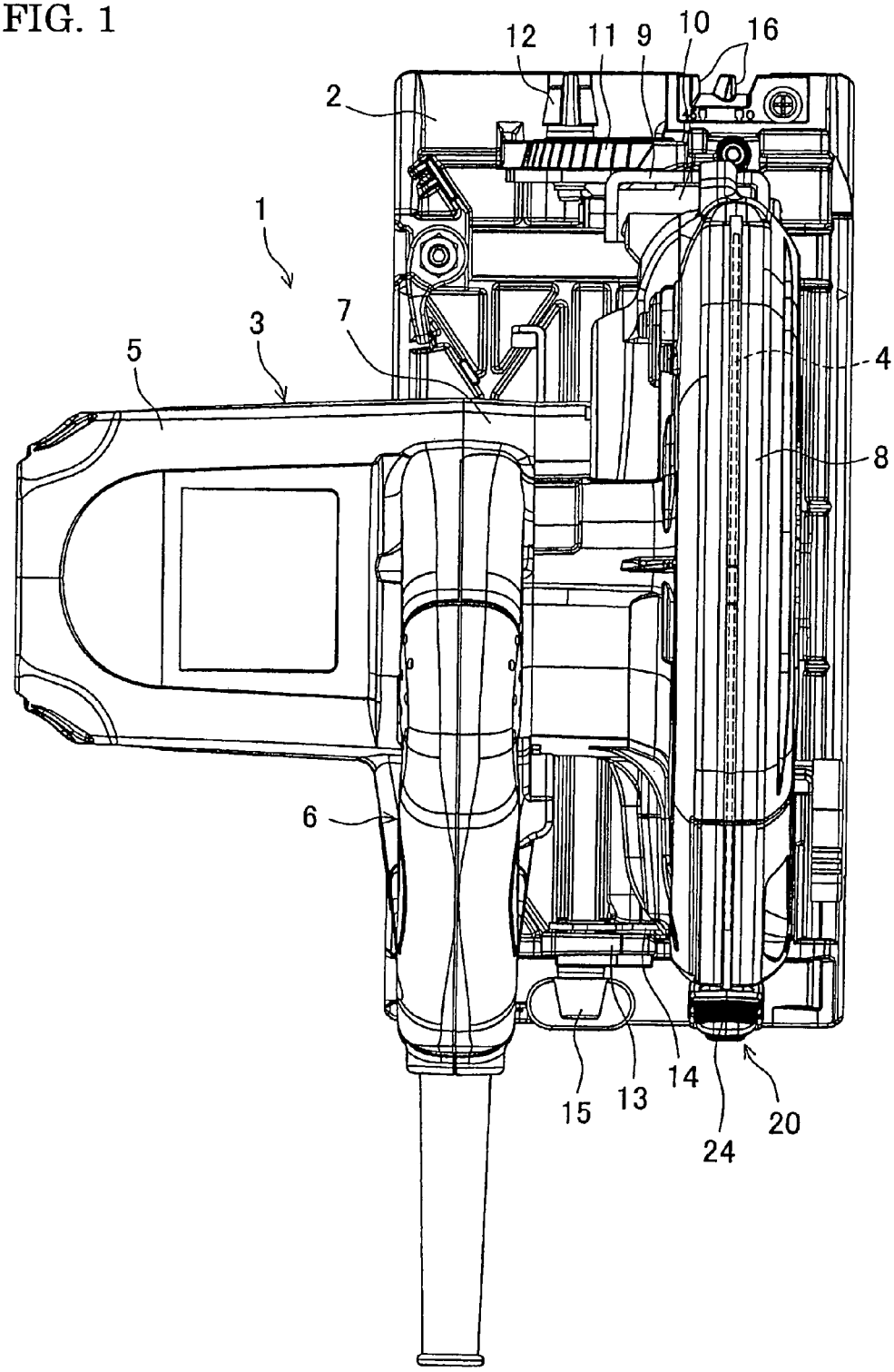
FIG. 1 is a plain view of a circular saw.

FIG. 1 is a plain view of a circular saw as one example of a cutting tool. A circular saw 1 has a base 2 which is rectangular in a plain view and a main body 3 provided on the base 2. The main body 3 has a circular saw blade 4 driven to rotate by a motor, being provided in the cutting direction (the vertical, or upper, direction of FIG. 1) and made to protrude below the base 2. The main body 3 includes a motor housing 5 accommodating the motor, a handle housing 7 in conjunction with the motor housing 5 to form a handle 6, and a blade case 8 covering the upper part of the saw blade 4. The blade case 8 is pivotally mounted on a connecting plate 9 which is lateral U-shaped in a plain view by means of an axis 10 on the front side of the cutting direction (in the upper direction of FIG. 1), so that the blade case 8 can rotate in the upper and lower directions. The connecting plate 9 is coupled to a sector guide plate 11 standing on the base 2 in the horizontal direction and having an arcuate guide groove (not shown), whereby the blade case 8 can be fixed at an arbitrary position along the guide groove by means of a thumbscrew 12.

On the other hand, at the rear side of the blade case 8, an arcuate guide plate 13 having likewise an arcuate guide groove (not shown) is standing on the base 2 in the horizontal direction. The lower end of a depth guide 14, which is curved toward the front as a guide member, is connected to this guide plate 13, so as to be fixed at an arbitrary position along the guide groove by means of the thumbscrew 15.

Since the upper portion of the depth guide 14 is inserted into the blade case 8 along the inner circumference thereof, the main body 3 can be fixed at an arbitrary tilting angle by changing engaging positions between the guide plates 11, 13 provided at the front and the rear of the base 2, and the corresponding connecting plate 9 and depth guide 14 respectively. The tilting angle ranges from an orthogonal position where the saw blade 4 crosses the base 2 at the right angle to a maximum tilting angle where the saw blade 4 is tilted to the right side at 45 degrees with respect to the base 2. With this configuration, a bevel cutting can be conducted. At the front end of the base 2, there are provided notches 16, 16 in which each lateral end is positioned on an extending surface of the saw blade 4 when the saw blade 4 is at the position orthogonal to the base 2 or at the position to be tilted to the angle of 45 degrees, respectively. By matching a black cut line indicated on a workpiece with the lateral end of the notches 16, 16, cutting operation in accordance with the black cut line can be easily conducted.

Figure 3B:
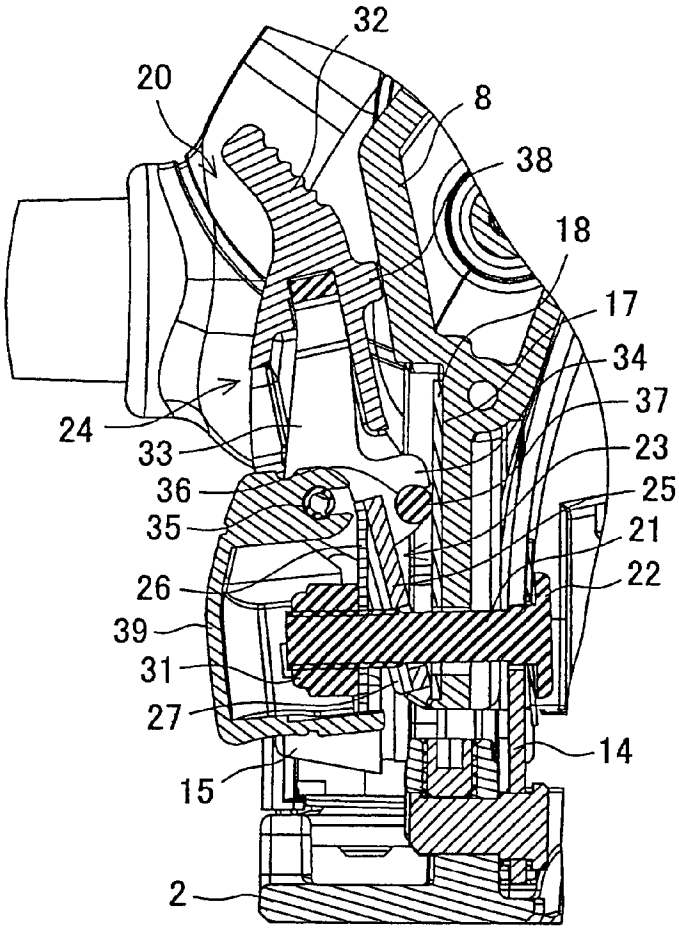
Figure 3A:
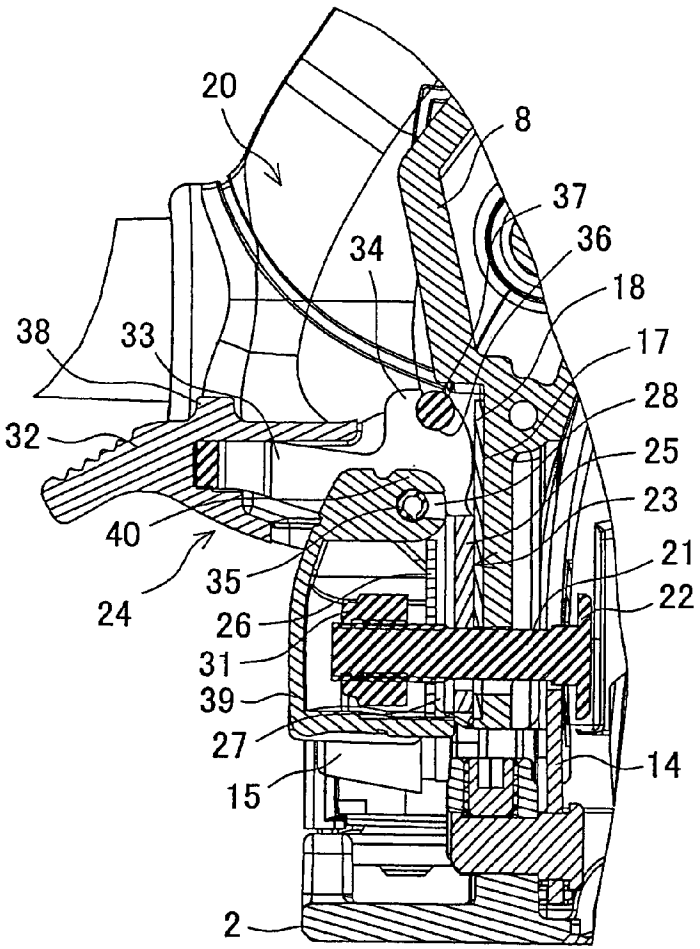
Figure 3C:
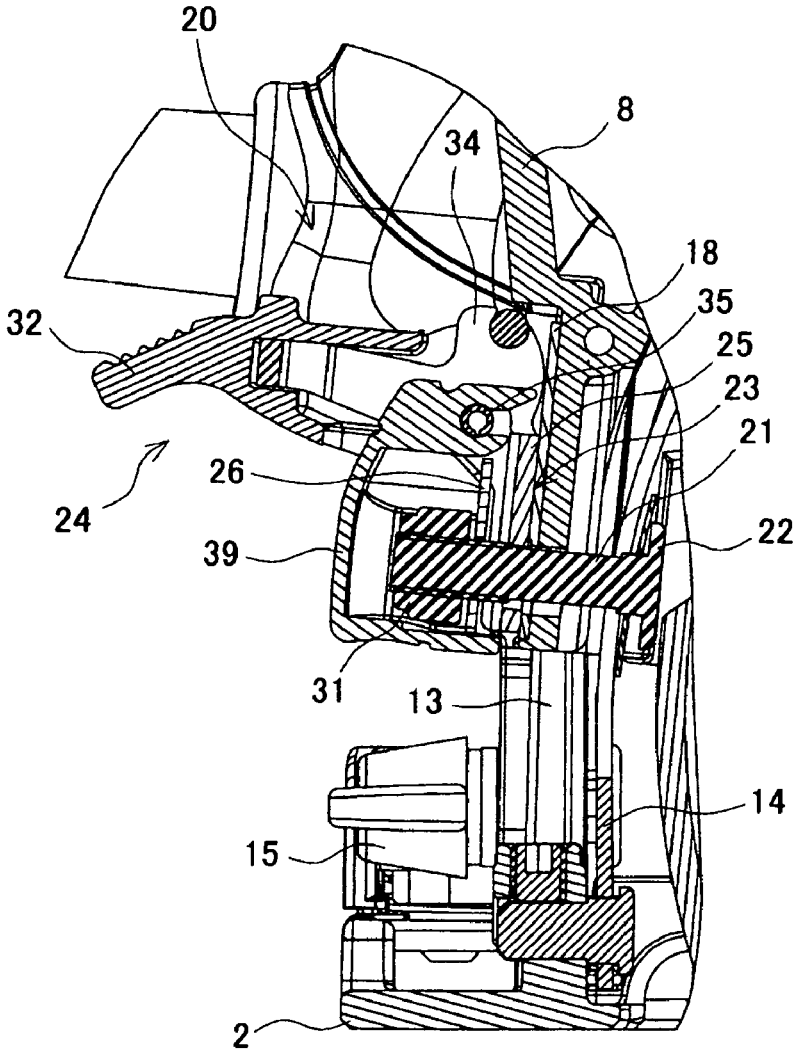
FIG. 3C is an explanation view that shows how the depth guide slides upward along the blade case from the position shown in FIG. 3A.

As shown in FIG. 3, a concave portion 17 accommodating a bottom plate 18 at the lower base thereof is provided at the rear outer circumference of the blade case 8. In the concave portion 17, a clamp mechanism 20 which can be switched between a clamped condition where the rear end of the blade case 8 is integrally fixed with the depth guide 14 and an unclamped condition where it is slidable along the depth guide 14. In this configuration, an amount of protrusion of the saw blade 4 (cutting depth) below the base 2 can be adjusted when the main body 3 is rotated in the downward direction about the axis 10 and the clamped position of the blade case 8 along the depth guide 14 is changed.

This clamp mechanism 20 is constituted by a clamp pin 21, a first lever 23 and a second lever 24 connected to the upper side of the first lever 23. The clamp pin 21 penetrates the depth guide 14 and the blade case 8, having a disc-shaped head portion 22 disposed at the inner side of the blade case 8 and a distal end made to protrude to the outside of the blade case 8. The first lever 23 connected to the protruding end of the clamp pin 21 to directly move the clamp pin 21 in the axial direction.

Figure 2A:
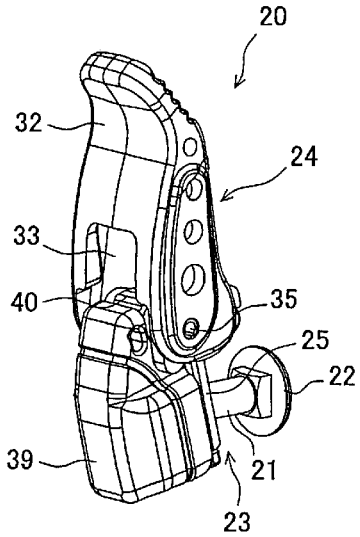
FIG. 2A is a perspective view of a clamp mechanism.
Figure 2B:
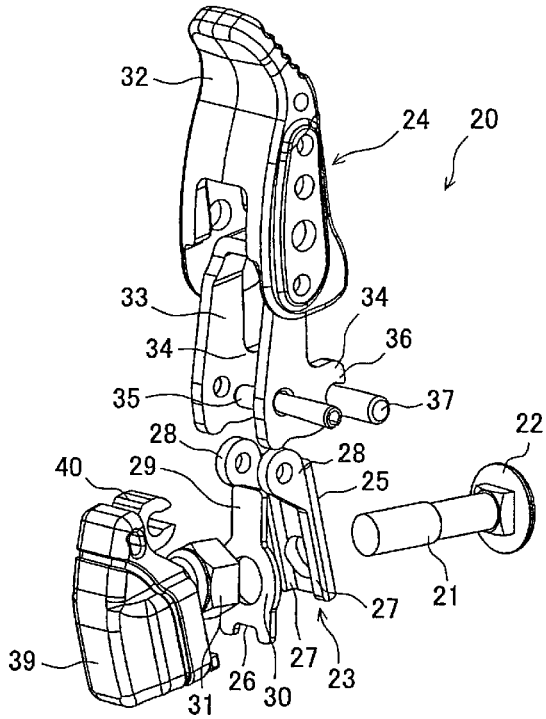
FIG. 2B is an exploded perspective view thereof.

As shown in FIG. 2, the first lever 23 is constituted by two members, which are, a tilting plate 25 inserted into the clamp pin 21 with play and a slide plate 26. The tilting plate 25 includes folded portions 27, 27 formed by folding both vertical side portions thereof to the opposite side from the bottom plate 18, and connecting portions 28, 28 formed on the upper end of the folded portions 27, 27 and serving as an attaching portion of the second lever 24. The slide plate 26 is tabular and disposed at the outer side of the tilting plate 25. The upper portion of the slide plate 26 is a strap portion 29 which is narrower than the interval between the folded portions 27, 27, while the lower portion of the slide plate 26 which is inserted into the clamp pin 21 with play is a circular portion 30 whose diameter is larger than the interval between the folded portions 27, 27. The distal end of the clamp pin 21 is threadedly inserted into a nut 31 provided at the outside of the slide plate 26.

Here, the clamp pin 21 has a two-staged configuration where a substantially half thereof on the head portion's 22 side has a smaller diameter and is inserted into the tilting plate 25 with play, whereas the other half on the distal end's side has a larger diameter and is inserted into the slide plate 26 with play. With this configuration, the tilting plate 25 is allowed to tilt with respect to the clamp pin 21, whereas the slide plate 26 is prevented from tilting with respect to the clamp pin 21. Consequently, when the upper end of the tilting plate 25 is pressed to rotate around a portion where the lower end of the tilting plate 25 of the first lever 23 contacts with the bottom plate 18 as a fulcrum toward the direction that is remote from the bottom plate 18, the slide plate 26 that contacts with the upper end of the tilting plate 25 is slid in the axial direction of the clamp pin 21 maintaining a substantially orthogonal state with respect to the clamp pin 21 until it abuts to the nut 31. As a result, the clamp pin 21 is pulled outward.

As shown in FIG. 2, the second lever 24 is constituted by two members, which are, a pawl-shaped operating handle 32 whose upper end is curved rearward, and a cam lever 33 inserted into the operating handle 32 from its lower end side. At the lower end of the cam lever 33, a pair of right and left cams 34, 34 are formed protruding to the side of the bottom plate 18 in a clamped condition shown in FIG. 3B. The cams 34, 34 are integrally connected to the lower end of the operating handle 32 through a connecting pin 35 which penetrates on the other side of the protruding direction of the cams 34, 34. Between the cams 34, 34, the connecting pin 35 also penetrates the connecting portions 28, 28 of the tilting plate 25 of the first lever 23, thereby connecting the tilting plate 25 and the cam lever 33.

Moreover, a roller 37 is housed in notches 36, 36 formed at the circumference of the cams 34, 34 of the cam lever 33 in a manner that the roller 37 penetrates the notches 36, 36 in the direction orthogonal to the cams 34, 34. The roller 37 is in a round shank shape and exposes its side surface to the side of the bottom plate 18. In a clamped condition, the roller 37 protrudes from the cams 34, 34 to the maximum length toward the bottom plate 18 so as to abut to the bottom plate 18. The reference number 38 denotes a stopper provided on the reverse side of the operating handle 32 so as to abut to the outer surface of the blade case 8 in a clamped condition.

At the outer side of the first lever 23, a covering cap 39 is mounted. The covering cap 39 covers the distal end portion of the clamp pin 21 including the nut 31. Moreover, the covering cap 39 is integrally provided with the slide plate 26 by engaging a C-shaped holding portion 40 provided at the upper end of the covering cap 39 with the connecting pin 35 for an integral operation with the slide plate 26.

In a circular saw 1 as configured above, when the clamp mechanism 20 is unclamped as shown in FIG. 3A, the second lever 24 is raised outward so as to be generally transversely-situated as the connecting pin 35 approaches to the bottom plate's side. Then the roller 37 is positioned above the connecting pin 35 and causes the cams 34, 34 to abut to the bottom plate 18. In the first lever 23, since the connecting pin 35 approaches to the bottom plate 18, the tilting plate 25 is in a lie-down position to abut to the surface of the bottom plate 18, and the slide plate 26 is at a backward position being parallel to the tilting plate 25 and abutting to the folded portion 27. Consequently, the rear end of the blade case 8 can be slid along the depth guide 14, because the interval between the depth guide 14 and the slide plate 26 interposing the blade case 8 is larger than that between the head portion 22 of the clamp pin 21 and the nut 31 interposing the blade case 8. As a result, the amount of protrusion of the saw blade 4 from the base 2 can be changed.

Upon determination of the amount of protrusion of the saw blade 4, when the operating handle 32 of the second lever 24 is rotated upward to lie down to the side of the blade case 8, the cams 34, 34 of the cam lever 33 are slid on the bottom plate 18 to press the connecting pin 35 to the direction that is remote from the bottom plate 18. Here, in this rotative operation of the second lever 24, as the roller 37 contacts with the bottom plate 18 and slides on the same, a load on the second lever 24 transmitted from the first lever 23 is reduced, which facilitates the operation.

When the connecting pin 35 is moved, the tilting plate 25 of the first lever 23 is inclined, in which the upper end thereof is pressed to the direction that is remote from the bottom plate 18 by the connecting portions 28, 28 as a force-applying point which is penetrated by the connecting pin 35, while the lower end thereof as a fulcrum abuts to the bottom plate 18 as shown in FIG. 3B. Then, as described above, as the slide plate 26 is pressed in the same direction by the upper end of the tilting plate 25, the slide plate 26 is moved along in the axial direction of the clamp pin 21, thereby pulling the clamp pin 21 in the same direction through the nut 31. As a result, the head portion 22 of the clamp pin 21 presses the depth guide 14 to the inner surface of the blade case 8, so that the blade case 8 and the depth guide 14 are fixed at respective positions. The setting of the pressure is adjustable by changing the length of thread engagement of the nut 31 with respect to the clamp pin 21.

On the other hand, upon switching to the unclamped condition from the clamped condition, contrary to the above, the second lever 24 is rotated to be raised outward. Then the connecting pin 35 approaches toward the bottom plate 18 in accordance with the rotation of the cam lever 33. With this operation, the tilting plate 25 of the first lever 23 is moved from an inclined state to a state parallel to the bottom plate 18 to release the slide plate 26. Consequently, the clamped pin pulled outward through the nut 31 is also released and the depth guide 14 becomes free, which returns to a condition shown in FIG. 3A.

The second lever 24 can be raised easily by holding the covering cap 39 with user's fingers. This is because the reactive force in accordance with rotation of the second lever 24 is transmitted to the connecting pin 35 through the covering cap 39. Therefore, pressure on the side of the second lever 24 is released without difficulty, which improves operability.

As described above, according to the circular saw 1 in the above embodiment, the first lever 23 that directly operates the clamp pin 21 of the clamp mechanism 20 is connected to the second lever 24 that rotates to be interlocked with the first lever 23. With rotative operation of the second lever 24, the clamp mechanism 20 can be switched between a clamped condition and an unclamped condition through the first lever 23. Because of this structure, the first lever 23 can be easily operated by utilizing the second lever 24 though the first lever 23 requires a heavy workload when it is operated directly. Consequently, a required workload is greatly reduced for the same clamping or unclamping effect compared with a single lever structure, which provides an excellent operability.

Moreover, the clamp mechanism 20 has the clamp pin 21 that protrudes to the outside of the blade case 8 while penetrating through the guide member 14 at the inner circumference thereof, and the first lever 23 connected with the clamp pin 21. The first lever 23 is rotated around a portion where the lever 23 abuts to the bottom plate 18 as a fulcrum for pulling and urging the clamp pin 21 in the protruding direction, thereby pressing the depth guide 14 to the inner circumference of the blade case 8. Moreover, there is provided the second lever 24 which is a cam lever 33 connected to the side of the force-applying point of the first lever 23. The second lever 24 slides on the bottom plate 18 when the second lever 24 is rotated to the side of the blade case 8 so as to press the side of the force-applying point of the first lever 23 toward the direction that is remote from the outer surface of the blade case 8. With this configuration, the second cam lever 24 is turned to the side of the blade case 8 in a clamped condition, which provides no protrusion from the blade case 8 even when two levers are provided. This structure prevents the second lever 24 from being an obstruct during operation and also prevents an accidental unclamping when the second lever 24 is knocked by a user's hand or an object. Therefore, an excellent operability can be maintained.

Moreover, since the roller 37 is provided at a portion where the cams 34, 34 of the cam lever 33 slide on the outer surface of the bottom plate 18, the workload for operating the second lever 24 is further reduced, which further improves operability.

Although in the above embodiment the second lever is constituted by two members, which are the operating handle and the cam lever, it may be constituted by the cam lever only, omitting the operating member. Moreover, arrangement of the roller or the connecting pin, and the configurations of the cam lever including the cams are not limited to the above embodiment as long as the second lever can be interlocked with the first lever. Further, the second lever is not limited to the cam lever structure that the first lever is moved by the cam sliding, instead a normal structure where the second lever is pivotally connected to the blade case for moving the first lever with the rotative operation.

In addition, the second lever may be constituted by a handle and a dial that is connected to the handle being gradually thicker in the circumferential direction. In such a case, the second lever is pivotally mounted on the blade case and the dial presses the side of the force-applying point of the first lever when the handle is rotated.

On the other hand, the first lever structure may be modified, such as changing its connecting portion with respect to the connecting pin, or omitting the slide plate so that the tilting plate directly presses the nut. When the slide plate is omitted, such a structure is acceptable that the first lever is not tabular but a cam lever as the second lever in the above embodiment, and the distal end of the clamp pin connected by a pin and the like is moved in accordance with the cam sliding.

In addition, in the clamp mechanism of the above embodiment, the depth guide is within the blade case for being pressed toward the inner circumference of the blade case.

However, even in the clamp mechanism as shown as a prior art in the Japanese Patent No. 3427431 where the guide member is disposed on the outer circumference of the blade case for being pressed from outside by a cam lever connected to the side of the blade case, the operation workload can be reduced by connecting the second cam with the cam lever likewise.

Besides the above, the covering cap may include a finger rest, or the covering cap or the bottom plate may be omitted. Further, the present invention may be applied to a circular saw without bevel cutting. Needless to say, cutting tools other than a circular saw, a cutter for example, may adopt the present invention.

What is claimed is:

1. A cutting tool comprising:

a base;

a main body provided on the base and having a cutting blade that rotates and is driven by a motor, and a blade case that covers an upper part of the cutting blade and has a front end pivotally mounted on the base so that the blade case is rotatable in upper and lower directions;

a guide member which stands on the base and along which a rear end of the blade case is slid in accordance with the rotative operation of the blade case, and a clamp mechanism provided with the blade case for being switched between a clamped condition where the guide member is pressed to be fixed to a side of the blade case and an unclamped condition where the fixing of the guide member is released by rotation of a first lever, wherein a second lever is connected to the first lever so as to be interlocked with the first lever that is rotated by the rotative operation of the second lever, wherein when the second lever is operated, the clamp mechanism is switched between the clamped condition and the unclamped condition through the rotative operation of the first lever, wherein the clamp mechanism comprises a clamp pin penetrating through the guide member disposed at the inner side of the blade case until the clamp pin protrudes to the outside of the blade case, and the first lever that is connected with the clamp pin and rotates around a portion where the first lever abuts to the outer surface of the blade case and acts as a fulcrum for pulling and urging the clamp pin in the protruding direction, thereby pressing the guide member to the inner circumference of the blade case, and the second lever is a cam lever connected to the side of a force-applying point of the first lever, and the second lever slides on the outer surface of the blade case when the second lever is rotated to the side of the blade case, whereby the force-applying point of the first lever is pressed toward a direction that is remote from the outer surface of the blade case.

2. A cutting tool according to claim 1, wherein the first lever comprises:

a tilting plate inserted into the clamp pin with play so as to be tilted with respect to the clamp pin, and a slide plate inserted into the clamp pin with play at an outer side of the tilting plate, the slide plate being movable in the axial direction of the clamp pin maintaining a substantially orthogonal state with respect to the clamp pin and engaged with the distal end of the same, and wherein by pressing the end of the tilting plate toward the direction that is remote from the blade case, the tilting plate moves the slide plate in the axial direction for pulling and urging the clamp pin.

3. A cutting tool according to claim 2, wherein the clamp pin has a two-staged configuration where the diameter of a portion to be inserted into the tilting plate is smaller than that of a portion to be inserted into the slide plate.

4. A cutting tool according to claim 2, wherein the clamp pin penetrates through the slide plate to be threadedly engaged with a nut provided at the outside of the slide plate, whereby the clamp pin is engaged with the slide plate.

5. A cutting tool according to claim 2, wherein the tilting plate includes folded portions formed by folding both vertical sides thereof to the opposite side from the blade case, and an attaching portion to be attached to the second lever is provided with the upper ends of the folded portions.

6. A cutting tool according to claim 5, wherein the upper portion of the slide plate is a strap portion which is narrower than the interval between the folded portions of the tilting plate, while the lower portion of the slide plate which is inserted into the clamp pin with play is a circular portion whose diameter is larger than the interval between the folded portions.

7. A cutting tool according to claim 2, wherein a covering cap that covers the distal end portion of the clamp pin to be integrally connected with the slide plate is provided at the outside of the first lever.

8. A cutting tool according to claim 1, wherein the cam lever has a cam that protrudes to the side of the blade case at the lower end thereof in the clamped condition, and the upper end of the first lever is connected to the cam lever on the side opposite to the protruding side of the cam.

9. A cutting tool according to claim 8, wherein a roller is provided with the cam of the cam lever at the sliding portion with respect to the outer surface of the blade case.

10. A cutting tool according to claim 8, wherein the cam lever is integrally provided with a pawl-shaped operating handle whose upper end is curved rearward, and a stopper that abuts to the outer surface of the blade case in the clamped condition is provided on the reverse side of the operating handle.

11. A cutting tool according to claim 1, wherein the clamp mechanism is provided in a concave portion formed at the rear outer circumference of the blade case and accommodating a bottom plate at the lower base thereof.

12. A cutting tool according to claim 1, wherein the blade case is tilted at an arbitrary angle in the direction orthogonal to the cutting direction on the base.

13. A cutting tool according to claim 11, wherein the guide member is integrally connected to a guide plate that guides the blade case to a tilting position.

14. A cutting tool according to claim 1, wherein a motor housing accommodating the motor is connected to one side of the blade case, and the cutting blade is provided in the blade case orthogonally to an output shaft of the motor.

15. A cutting tool according to claim 1, wherein the base is rectangular in a plain view and a notch, whose lateral end is positioned on an extending surface of the cutting blade, is provided at the front end of the base.

* * * * *